US006776313B2

(12) United States Patent
Yquel

(10) Patent No.: US 6,776,313 B2
(45) Date of Patent: Aug. 17, 2004

(54) VALVE FOR A PRESSURIZED RECEPTACLE, AND A RECEPTACLE FITTED THEREWITH

(75) Inventor: Jean-Pierre Yquel, Colombes (FR)

(73) Assignee: L'Oreal (FR)

( * ) Notice: Subject to any disclaimer, the term of this patent is extended or adjusted under 35 U.S.C. 154(b) by 0 days.

(21) Appl. No.: 10/648,455

(22) Filed: Aug. 26, 2003

(65) Prior Publication Data

US 2004/0074930 A1 Apr. 22, 2004

Related U.S. Application Data

(60) Provisional application No. 60/411,759, filed on Sep. 19, 2002.

(30) Foreign Application Priority Data

Aug. 30, 2002 (FR) ..... 02 10781

(51) Int. Cl.[7] ..... B65D 83/00
(52) U.S. Cl. ..... 222/402.1
(58) Field of Search ..... 222/402.1, 464.1, 222/402.19

(56) References Cited

U.S. PATENT DOCUMENTS 3,169,677 A 2/1965 Focht

FOREIGN PATENT DOCUMENTS

| | | |
|---|---|---|
| EP | 0 478 395 A2 | 4/1992 |
| EP | 1 170 247 A1 | 1/2002 |
| FR | 2 680 161 A1 | 2/1992 |

*Primary Examiner*—Philippe Derakshani
(74) *Attorney, Agent, or Firm*—Lerner, David, Littenberg, Krumholz & Mentlik, LLP

(57) ABSTRACT

Valves for use in a pressurized receptacle are disclosed including a housing and an orifice in the housing for dispensing a fluid, a shutter disposed in the housing and movable along the axis of the housing under the action of gravity between a closed position in which the shutter substantially closes the orifice when the valve is in a predetermined orientation and a dispensing position in which the shutter releases the orifice, and an absorber disposed downstream from the shutter relative to the direction of flow of the fluid, the absorber adapted to absorb a propellant gas contained within the fluid and for releasing propellant gas upon a decreasing pressure in the area adjacent to the absorber.

26 Claims, 3 Drawing Sheets

VALVE FOR A PRESSURIZED RECEPTACLE, AND A RECEPTACLE FITTED THEREWITH

FIELD OF THE INVENTION

The present invention relates to valves for fitting to pressurized receptacles.

BACKGROUND OF THE INVENTION

French patent application FR-A-2 680 161 describes a valve for a pressurized receptacle that includes a shutter member constituted by a ball. The ball is intended to close an orifice through which the dispensing fluid passes whenever the receptacle is not in a normal position of use, and in which case actuating the valve might lead, for example, to propellant gas being lost. In the event of an attempt to use the device in the wrong position, the pressure downstream from the shutter member tends towards atmospheric pressure because of the communication with the outside that is established through the valve rod when the valve is actuated. The ball is then liable to remain pressed against its seat, even if the receptacle is turned back into the normal position of use, because the pressure inside the receptacle is greater than the pressure downstream from the shutter member.

In order to prevent the shutter member remaining for too long a time in its closing position, even after the receptacle has been put back in its normal position of use, a leak is provided for between the inside of the valve body downstream from the shutter member and the inside of the receptacle by means of a micro-orifice passing through the valve body.

Making such a micro-orifice turns out to be relatively difficult and complicates manufacture of the valve.

In addition, the valve has a gasket which is liable to become swollen in contact with the fluid contained in the receptacle, and swelling of this gasket tends to disturb the passage of propellant gas through the micro-orifice, thereby further complicating manufacture of the valve.

One object of the present invention is thus to provide a valve which makes it possible to avoid the shutter member being held in its closing position even after the receptacle has been turned over into a normal position of use, and that is relatively simple to implement while also being reliable.

SUMMARY OF THE INVENTION

This and other objects have now been realized by the invention of a valve for use in a pressurized receptacle containing a fluid to be dispensed therefrom with at least one propellant gas, the valve comprising a housing having an axis, an inner wall, and including an orifice for dispensing the fluid, a shutter member disposed in the housing, the shutter member movable along the axis under the action of gravity between a closed position in which the shutter member substantially closes the orifice when the valve is in a predetermined orientation and a dispensing position in which the shutter member releases the orifice, and an absorber disposed downstream from the shutter member relative to the direction of flow of the fluid, the absorber adapted to absorb the at least one propellant gas contained within the fluid and for releasing at least a portion of the at least one propellant gas upon a decrease in pressure in the area adjacent to the absorber. Preferably, the absorber comprises porous material.

In accordance with one embodiment of the valve of the present invention, the absorber comprises a material capable of absorbing the at least one propellant gas.

In accordance with another embodiment of the valve of the present invention, the absorber comprises polyamide fibers, preferably nylon fibers. In another embodiment, the absorber comprises a separate sintered member. In yet another embodiment, the absorber comprises silicone.

In accordance with another embodiment of the valve of the present invention, the housing comprises a valve body, and the valve includes a chamber in fluid communication with the valve body by means of the orifice, wherein the absorber is disposed in the chamber. Preferably, the absorber is affixed to the valve body.

In accordance with another embodiment of the valve of the present invention, the valve includes a valve rod, wherein the absorber is affixed to the valve rod. Preferably, the valve rod includes a first end, and the absorber is affixed to the first end of the valve rod.

In accordance with another embodiment of the valve of the present invention, the housing comprises a valve body, and the shutter member is disposed in the valve body.

In accordance with another embodiment of the valve of the present invention, the valve includes a dip tube affixed to the valve body, the shutter member being disposed in the dip tube.

In a preferred embodiment of the valve of the present invention, the shutter member comprises a ball.

In accordance with one embodiment of the valve of the present invention, the predetermined orientation comprises a head-down position for the valve, and the position for normal use of the valve comprises a head-up position for the valve. In another embodiment, however, the predetermined orientation comprises a head-up position for the valve and the position for normal use of the valve comprises a head-down position for the valve.

In accordance with another embodiment of the valve of the present invention, the valve includes actuation means for actuating the valve, the actuation means being actuated by being depressed. In another embodiment, the actuation means being actuated by being rocked.

In accordance with the present invention, a dispensing device has been discovered for dispensing a fluid comprising a pressurized receptacle containing the fluid and a valve as defined hereinabove.

In one embodiment, the present invention provides a valve for a pressured receptacle, the valve comprising:

an orifice configured to pass a fluid to be dispensed;

a shutter member movable under the action of gravity between a closing position taken when the valve has a predetermined orientation, in which closing position the shutter member substantially closes the orifice, and a dispensing position in which the shutter member releases the orifice; and an absorber situated downstream from the shutter member relative to the direction of fluid flow, suitable for absorbing at least a propellant gas contained in the fluid and for releasing at least part of the propellant gas when the pressure in the vicinity of the absorber becomes low enough.

The shutter member is particularly configured in such a manner that the quantity of propellant gas that is released enables the pressure difference that exists across opposite sides of the shutter member to be reduced sufficiently for the shutter member to be able to leave its closing position in the event of the shutter member remaining in its closing position while no longer being held in its closing position by gravity.

The shutter member can leave its closing position on its own under gravity and/or under the action of movements of the receptacle.

The absorber may be made of a material and/or of a physical structure that are selected as a function of the nature of the substance(s) contained in the receptacle, in particular the nature of the propellant gas and the quantity of gas that is to be released by desorption, taking into account, for example, the configuration of the valve and the volume that the gas released by desorption is to occupy, the weight of the shutter member, the pressure that exists inside the receptacle, the shape of the shutter member, and the shape of its seat.

The absorber may comprise a porous material. The absorber may also comprise a material whose chemical nature enables it to absorb the propellant gas contained in the fluid. The absorber may be configured, for example, so as to be capable of absorbing a propellant gas selected from the group constituted by: alkanes, in particular butane, isopropane, and isobutane; fluorine-containing compounds, in particular difluoroethane 152*a*, and tetrafluoroethane 134*a*; and dimethyl ether, this list not being limiting.

The absorber may comprise fibers of polyamide, e.g. of nylon.

The absorber may comprise a cellular material, for example a foam or a sintered piece, in particular a sintered piece having high porosity with pores of a size that may lie, for example, in the range from about 5 microns ($\mu$m) up to about 20 $\mu$m.

The sintered piece may be constituted, for example, by a piece of sintered high density polyethylene, polypropylene, or polyvinylidene fluoride (PVDF).

The absorber may also comprise a silicone, in particular when the propellant gas is butane, isobutane, difluoroethane 152*a*, tetrafluoroethane 134*a*, dimethyl ether, or a mixture of at least two such compounds, because of the affinity that exists between silicone and the propellant gas.

The valve may comprise a valve body defining a chamber with which the above-mentioned orifice communicates, the chamber being situated downstream from the shutter member, and the absorber being disposed in the chamber. By way of example, the absorber may be fixed to the valve body. In a variant, or additionally, the absorber may be fixed to the valve rod. In particular, the absorber may be fixed to one end of the valve rod.

The shutter member may be disposed in a housing in the valve body. In a variant, the shutter member may be disposed in a dip tube fixed to the valve body.

The shutter member may comprise a ball, in particular a glass ball or a stainless steel ball.

The above-mentioned predetermined position which the shutter member occupies in its closing position may correspond to an attempt at using the valve in a head-down position. In that case, the receptacle is normally used in a head-up position in order to dispense the fluid contained inside. A dip tube may be fixed to the valve body.

The predetermined position in question may also correspond to an attempt at using the valve in a head-up position. In this case, the receptacle is normally used head-down. The valve need not have a dip tube.

The valve may be configured so as to be actuated by being depressed or rocked, for example.

The present invention also provides a device for packaging and dispensing a fluid, the device comprising:

- a receptacle containing the fluid to be dispensed under pressure; an
- a valve as defined above.

BRIEF DESCRIPTION OF THE DRAWINGS

The present invention can be better understood on reading the following description of non-limiting embodiments thereof, and on examining the accompanying drawings, in which.

DETAILED DESCRIPTION

Figure 1:
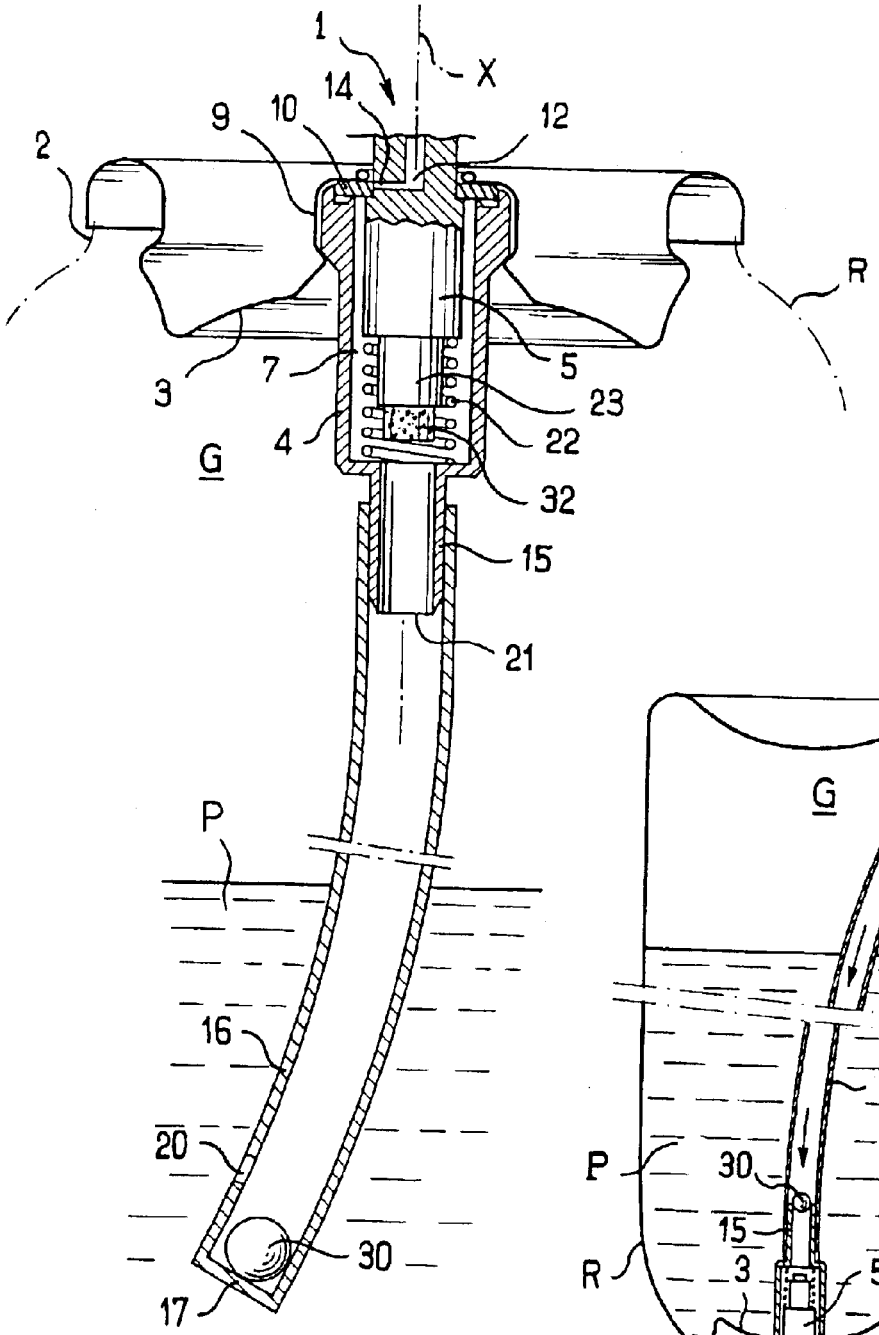
FIG. 1 is a side, elevational, partially sectional and fragmentary view of a pressurized receptacle fitted with a valve in accordance with one embodiment of the present invention.

FIG. 1 shows a valve 1 in accordance with the present invention mounted on a pressurized receptacle R.

The receptacle R contains a fluid P for spraying under the pressure of a propellant gas G such as isobutane, difluoroethane 152*a*, tetrafluoroethane 134*a*, or dimethyl ether, for example.

In its top portion, the receptacle R has an opening 2 with a cup 3 crimped thereon in a conventional manner. The valve 1 is crimped in a central housing 9 of the cup 3.

The valve 1 presents a valve body 4 defining a chamber 7 in which a valve rod 5 having a longitudinal axis X is engaged and suitable for moving inside the chamber 7 between a valve-closed position and an open position.

Figure 2:
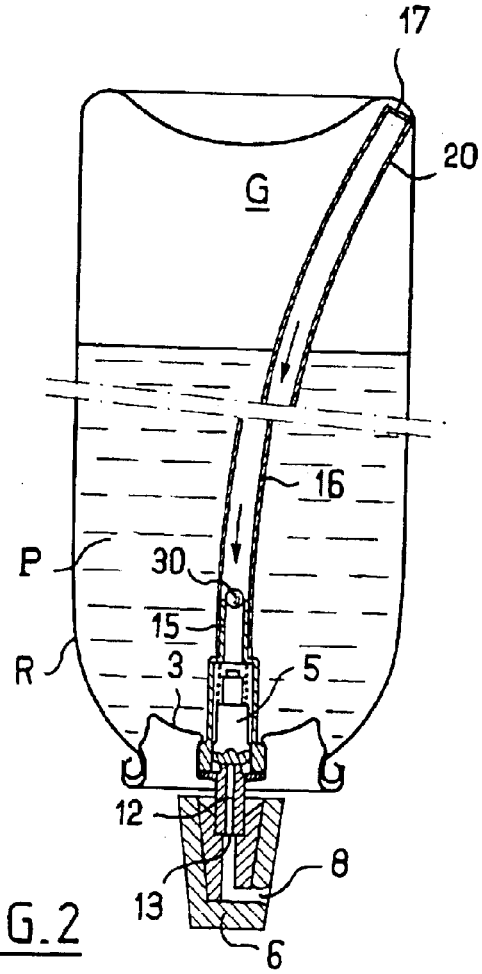
FIG. 2 is a side, elevational, partially sectional, fragmentary view of the receptacle shown in FIG. 1 in a head-down position.

At its end emerging from the valve body 4, the valve rod 5 is provided with a pushbutton 6, as can be seen in FIG. 2. The pushbutton 6 has an internal channel 8 which may optionally be fitted with one or more swirling channel nozzles, for example, depending on the type of aerosol that is desired and on the nature of the fluid that is to be sprayed, for example.

A sealing washer 10 is interposed between the valve body 4 and the cup 3.

The valve rod 5 can slide inside the valve body 4 along the axis X in a leaktight manner in contact with the washer 10.

A dispensing channel 12 is formed inside the valve rod 5. This channel opens out at one end into the inside channel 8 of the pushbutton 6, and at its other end into a side surface of the valve rod 5 by means of a radial orifice 14.

In the valve-closed position, as shown in FIG. 1, the orifice 14 is closed by the washer 10.

In order to dispense the fluid P, the valve rod 5 in the example described is depressed into the valve body 4 so that the orifice 14 opens out below the washer 10 into the chamber 7. The fluid P can then flow into the dispensing channel 12.

The valve 1 has a helical spring 22 urging the valve rod 5 towards its closed position, as shown in FIG. 1, whenever it is released by the user.

The bottom portion of the valve rod 5 comprises a cylindrical portion 23 of axis X that is used for guiding the spring 22.

The bottom end of the valve body 4 carries a spigot 15 having a dip tube 16 fixed thereon. The spigot 15 opens out through an orifice 21 of circular section into the dip tube.

The dip tube 16 is closed at its bottom end by an end wall 17 and a ball 30 is retained inside the dip tube.

A side opening 20 is made in the dip tube 16 close to its end wall 17, the opening 20 opening out into the space situated immediately above the ball 30 when the ball is resting on the end wall 17.

The ball 30 is free to move inside the dip tube 16 under the action of gravity.

When the receptacle R is in its normal position of use, the ball 30 rests on the bottom wall 17 of the dip tube 16, as shown in FIG. 1.

The orifice 21 is closed by the ball 30 when the receptacle R is turned upside-down, in an attempt to dispense the fluid P while the receptacle is in a head-down position, as shown in FIG. 2.

In this position, when the user presses on the pushbutton 6, the propellant gas G is prevented from traveling through the orifice 21 and the pressure inside the chamber 7 can become equal to atmospheric pressure through the dispensing channel 12.

In order to ensure that the ball 30 does not remain blocked in its position closing the orifice 21 under the effect of the pressure difference across the ball, an absorber 32 is disposed inside the chamber 7, with this absorber 32 being fixed to the cylindrical portion 23 of the valve rod 5 in the example described.

In the example shown, the absorber 32 is made of a porous material having high porosity suitable for absorbing propellant gas G in the liquid state, and possibly also some of the fluid P.

By desorbing the propellant gas G, the absorber 32 serves to increase the pressure that exists inside the chamber 7 after the valve rod 5 has been returned to the closed position, and consequently this enables the pressure difference between the upstream and downstream sides of the ball 30 to be reduced.

The absorber 32 is configured so that the volume of gas that is released by desorption is sufficient to enable the ball 30 to leave the orifice 21 under gravity and/or under the action of movements imparted to the receptacle while it is being handled by the user.

In the example described above, the absorber 32 is fixed to the valve rod 5.

Figure 3:
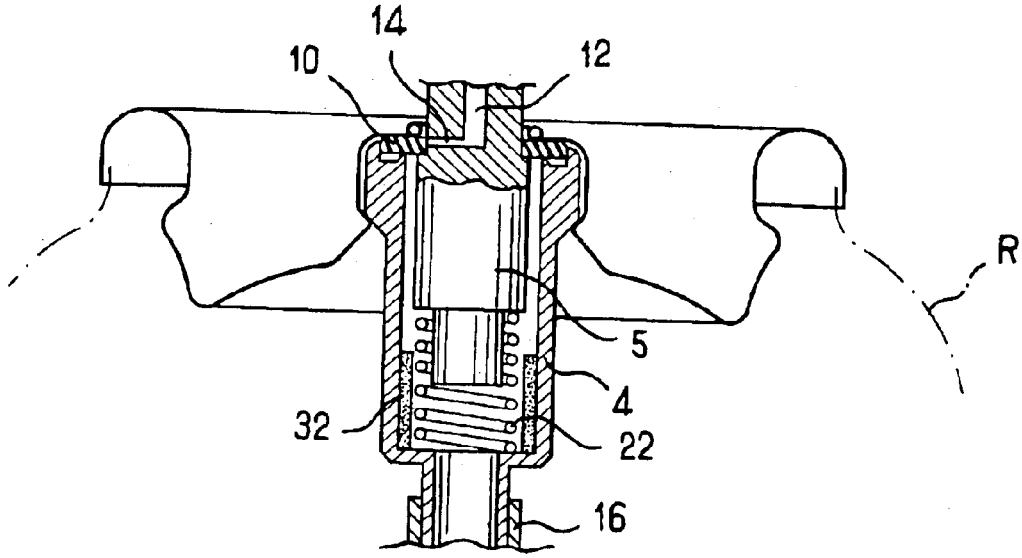
FIG. 3 is a side, elevational, partially sectional, fragmentary view of a valve in accordance with one embodiment of the present invention.

In a variant, as shown in FIG. 3, the absorber 32 may be fixed to the valve body 4.

Specifically, the absorber 32 may be in the form of a ring disposed around the spring 22 and bearing against a shoulder of the valve body 4.

It would not go beyond the ambit of the present invention if, instead of putting the shutter member in a dip tube, a housing were to be provided in the valve body for receiving the shutter member.

Figure 4:
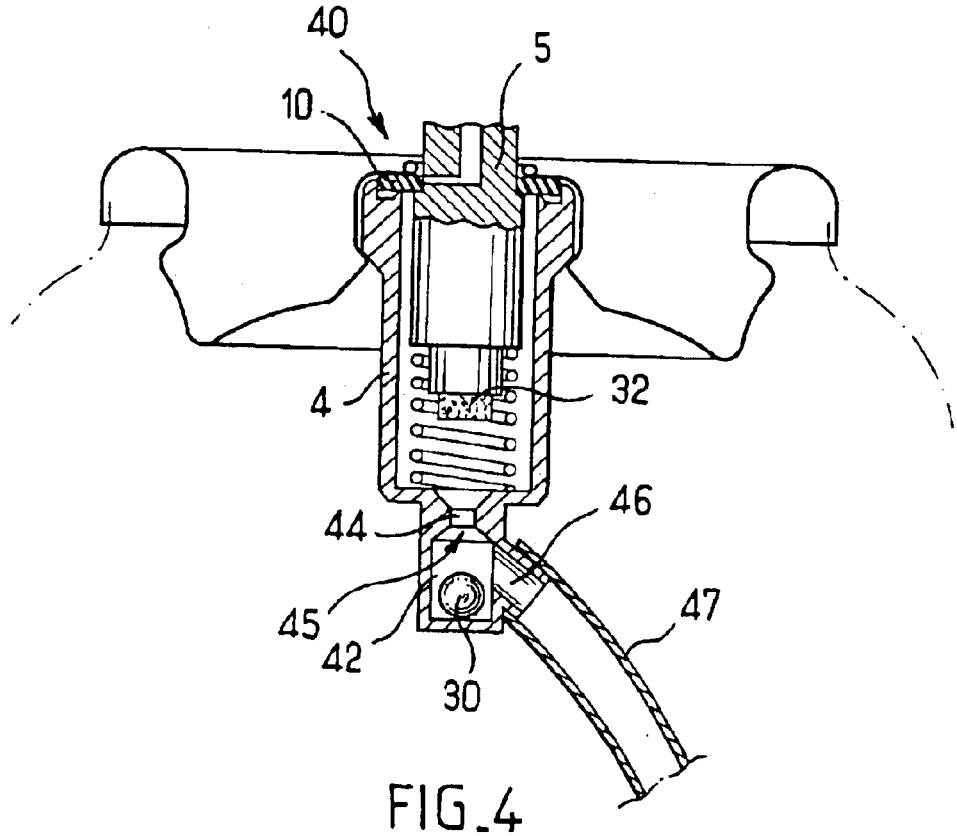
FIG. 4 is a side, elevational, partially sectional, fragmentary view of another valve in accordance with the present invention.

By way of example, FIG. 4 shows a valve 40 that differs from the valve 1 described above by the fact that the valve body 4 comprises not only its chamber 7, but also a housing 42 at its bottom end in which the ball 30 is disposed.

This housing 42 communicates with the chamber 7 by means of an orifice 44 and it also communicates with the inside of the receptacle by means of a lateral spigot 46 having a dip tube 47 fixed thereon, which dip tube may be open at its bottom end.

When the receptacle is turned upside-down in an attempt to use it in a head-down position, the ball 30 closes the orifice 44.

The absorber 32 acts as described above.

In the examples described above, the valve is normally used in a head-up position.

It would not go beyond the ambit of the present invention for the valve to be configured for head-down use.

Figure 5:
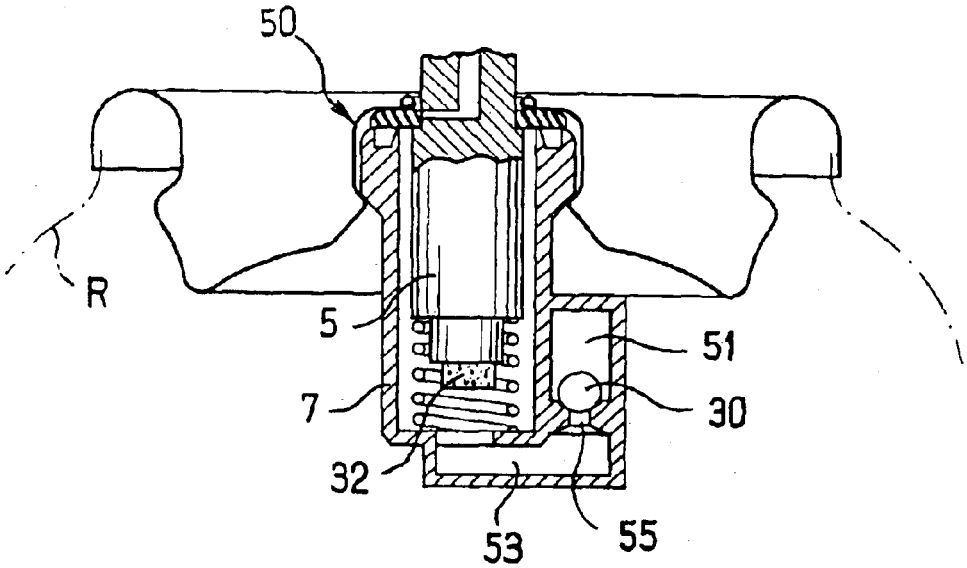
FIG. 5 is a side, elevational, partially sectional, fragmentary view of another valve in accordance with the present invention.

By way of example, FIG. 5 shows a valve 50 for normal use in a head-down position, the chamber 7 communicating by means of a channel 53 with a housing 51 containing the ball 30. The channel opens out into the housing 51 by means of an orifice 55 situated at the bottom end of the housing 51.

In an attempt to use the receptacle in a head-up position, as shown in FIG. 5, the ball 53 closes the orifice 55, thereby preventing the fluid P and the propellant gas G contained in the receptacle from penetrating into the chamber 7. The absorber 32 acts as before.

When the receptacle R is placed in a head-down position, the ball 30 disengages the orifice 55, and the fluid P can travel into the chamber 7 in order to be dispensed.

In the examples described above, the shutter member 30 can move freely within the space that contains it.

It would not go beyond the ambit of the present invention for means to be provided that serve to retard displacement of the shutter member between its dispensing and closing positions.

Figure 6:
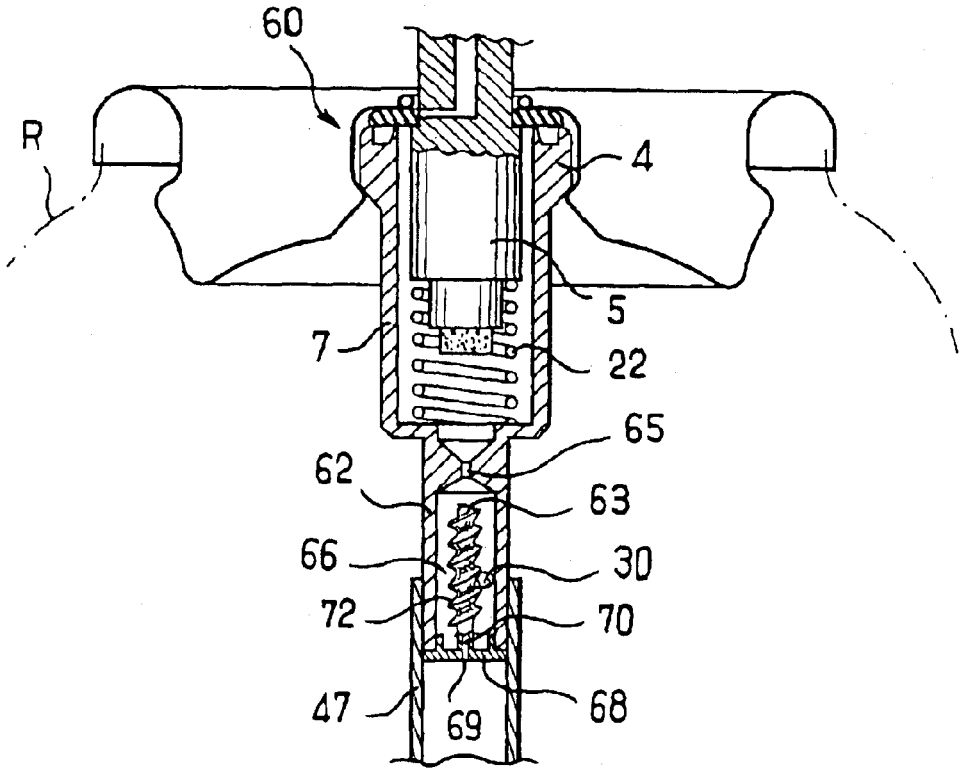
FIG. 6 is a side, elevational, partially sectional, fragmentary view of another valve in accordance with the present invention.

By way of example, FIG. 6 shows a valve 60 comprising a valve body 4 having a spigot 62 at its bottom end suitable for engaging a dip tube 47, as shown.

The spigot 62 defines a housing 66 which communicates with the chamber 7 by means of an orifice 65.

A ball 30 is present in the housing 66 to close the orifice 65 when the receptacle is not in its normal position of use.

The housing 66 is closed at its bottom end by an endpiece 68 provided with an orifice 69 for passing the fluid.

A threaded hollow rod 63 is placed inside the housing 66. This rod 63 has an inside channel 70 serving to feed the orifice 65 with the fluid that has penetrated through the orifice 69.

The rod 63 has a thread 72 which co-operates with the wall of the spigot 62 to define a helical path along which the ball 30 travels under the action of gravity when the receptacle is turned upside-down, thereby enabling the ball to reach its position in which it closes the orifice 65.

When the receptacle is head-up, as shown in FIG. 6, the ball 30 does not run any risk of being thrown against the orifice 65 due to movement of the receptacle, thereby interrupting dispensing, because this is prevented by the presence of the threaded hollow rod 63.

The present invention is not limited to the embodiments descried above.

In particular, the valve body could be made to have yet other shapes.

The valve may be configured to enable dispensing to take place when the valve rod is pivoted instead of being depressed.

Throughout the description, including in the claims, the term "comprises a" should be understood as being synonymous with "comprises at least one" unless specified to the contrary.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A valve for use in a pressurized receptacle containing a fluid to be dispensed therefrom with at least one propellant gas, said valve comprising an orifice-forming member defining an orifice for dispensing said fluid, a shutter member movable under the action of gravity between a closed position in which said shutter member substantially closes said orifice when said valve is in a predetermined orientation and a dispensing position in which said shutter member releases said orifice, and an absorber disposed downstream from said shutter member relative to the direction of flow of said fluid, said absorber adapted to absorb said at least one propellant gas contained within said fluid and for releasing at least a portion of said at least one propellant gas upon a decrease in pressure in the area adjacent to said absorber.

2. The valve of claim 1 wherein said absorber comprises porous material.

3. The valve of claim 1 wherein said absorber comprises a material capable of absorbing said at least one propellant gas.

4. The valve of claim 1 wherein said absorber comprises a material having a chemical nature enabling said absorber to absorb said at least one propellant gas contained in a fluid.

5. The valve of claim 1 wherein said at least one propellant gas is selected from the group consisting of an alkane, a fluorine-containing compound and dimethyl ether.

6. The valve of claim 1 wherein said absorber comprises polyamide fibers.

7. The valve of claim 1 wherein said absorber comprises a separate sintered member.

8. The valve of claim 1 wherein said absorber comprises silicone.

9. The valve of claim 1 wherein said valve comprises a valve body, and including a chamber in fluid communication.

10. The valve of claim 9 wherein said absorber is affixed to said valve body.

11. The valve of claim 1 including a valve rod, wherein said absorber is affixed to said valve rod.

12. The valve of claim 11 wherein said valve rod includes a first end, and wherein said absorber is affixed to said first end of said valve rod.

13. The valve of claim 1 wherein said valve comprises a valve body, and wherein said shutter member is disposed in said valve body.

14. The valve of claim 1 wherein said valve comprises a valve body, and including a dip tube affixed to said valve body, said shutter member being disposed in said dip tube.

15. The valve of claim 1 wherein said shutter member comprises a ball.

16. The valve of claim 1 wherein said predetermined orientation comprises a head-down position for said valve, and wherein the position for normal use of said valve comprises a head-up position for said valve.

17. The valve of claim 1 wherein said predetermined orientation comprises a head-up position for said valve and wherein the position for normal use of said valve comprises a head-down position for said valve.

18. The valve of claim 1 including actuation means for actuating said valve, said actuation means being actuated by being depressed.

19. The valve of claim 1 including actuation means for actuating said valve, said actuation means being actuated by being rocked.

20. The valve of claim 5 wherein said alkane is selected from the group consisting of butane, isopropane and isobutane.

21. The valve of claim 5 wherein said fluorine-containing compound is selected from the group consisting of difluorethane 152*a* and tetrafluorethane 134*a*.

22. The valve of claim 6 wherein said polyamide fibers comprises nylon fibers.

23. A dispensing device for dispensing a fluid comprising a pressurized receptacle containing said fluid and a valve as defined in claim 1.

24. The device of claim 20 wherein said at least one propellant gas is selected from the group consisting of an alkane, a fluorine-containing compound and dimethyl ether and wherein said absorber is adapted to absorb said at least one propellant gas.

25. The valve of claim 24 wherein said alkane is selected from the group consisting of butane, isopropane and isobutane.

26. The valve of claim 24 wherein said fluorine-containing compound is selected from the group consisting of difluoroethane 152*a* and tetrafluoroethane 134*a*.

* * * * *